United States Patent [19]

Horobin

[11] Patent Number: 4,884,382

[45] Date of Patent: Dec. 5, 1989

[54] MODULAR BUILDING-BLOCK FORM

[76] Inventor: David D. Horobin, 1640 S. Claudina Way, Anaheim, Calif. 92805

[21] Appl. No.: 195,641

[22] Filed: May 18, 1988

[51] Int. Cl.[4] ..... E04C 1/14; E04C 2/00

[52] U.S. Cl. ..... 52/426; 52/309.12; 52/564

[58] Field of Search ..... 52/426–428, 52/562, 564, 568, 309.11, 309.12, 606, 607

[56] References Cited

U.S. PATENT DOCUMENTS

| | | | |
|---|---|---|---|
| 994,027 | 5/1911 | O'Beirne | 52/568 |
| 1,751,748 | 3/1930 | Nash | 52/568 |
| 2,134,894 | 11/1938 | Schubert | 52/568 |
| 4,439,967 | 3/1984 | Dielenberg | 52/607 |
| 4,516,364 | 5/1985 | Heider | 52/593 |
| 4,706,429 | 11/1987 | Young | 52/564 |
| 4,731,968 | 3/1988 | Obino | 52/426 |

FOREIGN PATENT DOCUMENTS

| | | | |
|---|---|---|---|
| 700325 | 11/1953 | United Kingdom | 52/568 |

*Primary Examiner*—James L. Ridgill, Jr.
*Attorney, Agent, or Firm*—Francis X. LoJacono

[57] ABSTRACT

A modular concrete-block form which is shaped in a rectangular configuraiton and has a pair of oppositely disposed side panel members and end enclosure panels to define a body cavity to receive poured concrete therein. The side panels are held in a fixed parallel relation to each other and are further prevented from side-to-side movement relative to each other by a plurality of strut members which are fixedly mounted transversley from one side panel to the other. The unique arrangement of the strut members contributes to a very stable block framework. Each strut member is formed with substantially "H"-shaped tenon members that are slidably engaged with spaced-apart, "T"-shaped slots formed in the inner surfaces of said side panels. The panel structure is firmly grasped within the pair of opposed stud members that define the tenons. The tenons are integrally connected together by means of truss members that further define passages therethrough for flow of wet concrete therebetween.

3 Claims, 4 Drawing Sheets

MODULAR BUILDING-BLOCK FORM

BACKGROUND OF THE INVENTION

1. Field of the Invention

This invention relates generally to building-block forms for the construction of various types of concrete walls and related structures, and more particularly to a modular building-block form having attachable wall panels that are interconnectable by means of transverse strut members and closure panels, whereby the building blocks formed thereby are readily adapted to be arranged with selective custom wall structure designs of various widths and lengths.

2. Description of the Prior Art

Until the present invention, there did not exist suitable synthetic plastic modular building-block forms which were strongly constructed and capable of receiving with the forms a concrete material whereby the formed concrete walls could be readily assembled for building in a custom cost-effective manner.

Various types of concrete wall-forming structures have been employed in the concentration of not only walls but complete building structures as well. This type of construction is well known in the industry. More particularly, similar products have been used extensively in many European countries such as Germany, France, Switzerland and Belgium. In this connection, one may refer to French Pat. Nos. 1.580.113 and 928.002. Also, there is a Canadian Pat. No. 924922 issued Apr. 24, 1973.

Further in this connection, the following are United States patents that pertain to building-block forms:

994,027 to W. H. O'Beirne
2,181,698 to F. G. Langenberg
3,788,020 to W. K. Gregori
4,180,956 to F. Gross Other concrete forms are shown in the following United States patents:

4,223,501 to H. K. DeLozier
4,229,920 to W. D. Lount
4,263,765 to T. Maloney
4,516,372 to G. A. Grutsch
4,604,843 to R. P. Ott et al
4,706,429 to D. Young The majority of these patents relate generally to concrete forms made from low-density foamed plastic and polymeric material. However, none of them possesses the improvements as herein illustrated, described and claimed by the applicant.

SUMMARY AND OBJECTS OF THE INVENTION

The present invention is defined by a synthetic plastic (EPS) concrete form having a pair of oppositely disposed parallel panels made from expanded polystyrene, or EPS, which is a closed-cell, rigid, lightweight, cellular plastic, generally having a basic white texture that is molded into various shapes by means of steam and pressure, a process that is well known in the art. The two allochirally arranged longitudinal panels are interconnected by two means, one being end closure panels which help to define an inner open body cavity. The end closure panels are provided with tongue members that interlock with corresponding groove members formed in the inner face of each panel. The other connecting or interlocking panel-support members are defined by transversely positioned strut members having their distal ends formed in substantially "H"-shaped configurations and which are received in oppositely disposed slotted mortises. Thus, the longitudinally positioned side panels are held firmly in parallel relation to each other. The particular "H"-shaped configuration further prevents longitudinal movement of the respective side panels relative to each other.

Therefore, it is an important object of the present invention to provide a concrete-block-forming device that comprises a pair of substantially flat elongated panels that are interconnected by several specially designed strut members which support the elongated side panels in parallel relation as well as prevent lateral movement of the panels as concrete is poured within the cavities.

A further object of the invention is to provide a concrete-block-forming assembly wherein the side panels together with the respective end panels establish a rigid, lightweight, modular, building-block form made from expanded polystyrene material (EPS) so as to define a body cavity to receive concrete therein.

Still a further object of the present invention is to provide the use of a plurality of strut members which are constructed from a high-strength synthetic plastic and are formed in several different configurations to allow for varying sizes of concrete block forms to be assembled for the specific requirements of various wall structures. Each strut includes a midsection defined by a plurality of truss members being integrally formed with "H"-shaped tenons at opposite ends thereof.

Another object of the present invention is to provide a device of this character wherein the length of the block form can be selectively adjusted in two-inch increments, and wherein the width of the block form is established by the length of the transverse strut members used therewith. Accordingly, the overall width of the block form can be adjusted between four inches and sixteen inches, and the length thereof can be extended or shortened in two-inch increments up to an overall length of approximately forty inches, with the height thereof being a standard ten inches.

Still another object of the invention is to provide a device of this character that includes interlocking rail members formed along the longitudinal upper edge of each side panel and end panel, the bottom longitudinal edge being formed with corresponding interlocking grooves whereby the block forms are capable of being superposed on each other in an interlocking arrangement.

Yet another object of the present invention is to provide a synthetic plastic apparatus of this type that is designed with minimum beam size to withstand concrete (160 pounds per cubic foot) hydrostatic pressure and provide for a maximum cross-sectional area of concrete.

It is another object of the present invention to provide a device of this character that has relatively few parts, is simple to assemble at a construction site, and is easy to maintain thereafter.

It is still a further object of the invention to provide a device of this type that is relatively inexpensive to manufacture, is lightweight for ease in shipping in its disassembled form, and yet, when formed, provides a simple but rugged unit for use in the building of walls and other types of construction where concrete walls are employed.

The various features of novelty which characterize the invention are pointed out with particularly in the claims annexed to and forming a part of this disclosure. For a better understanding of the invention, its advantages by its use, reference should be had to the accompanying drawings and descriptive matter in which there are illustrated and described the preferred embodiments of the invention.

BRIEF DESCRIPTION OF THE DRAWINGS

Referring more particularly to the accompanying drawings, which are for illustrative purposes only.

DESCRIPTION OF THE PREFERRED EMBODIMENTS

Figure 1:
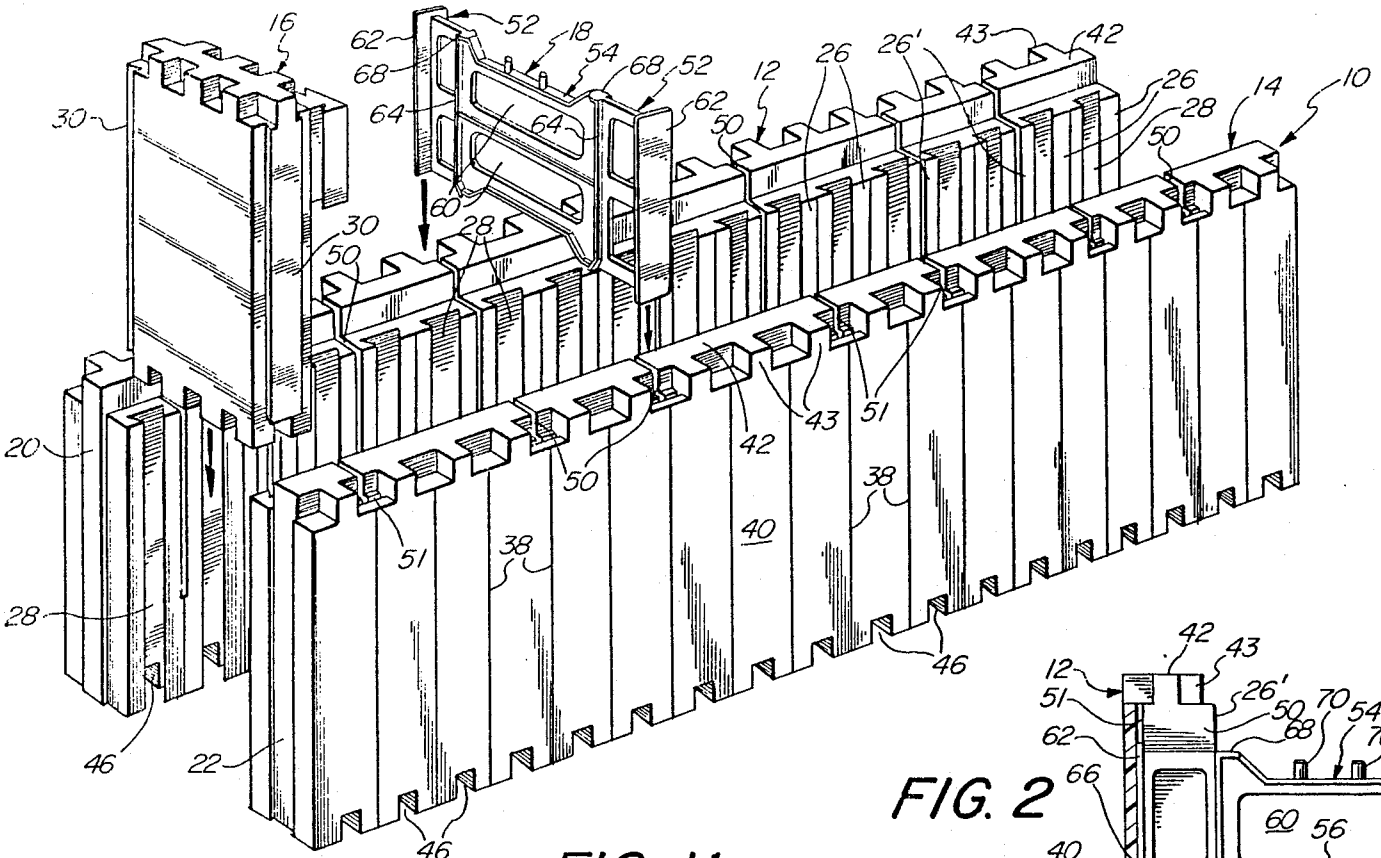
FIG. 1 is an enlarged, exploded, perspective view of the block-form assembly.

Referring first to FIG. 1 of the drawings, there is illustrated an exploded view of a modular concrete-block form, generally indicated at 10, for forming concrete structures and the like. The block form comprises a pair of modular concrete forming side panels 12 and 14 which are made from a suitable synthetic plastic material, preferably of expanded polystyrene which is well known in the art as a closed-cell, rigid, lightweight cellular plastic, generally white in color. The material is especially suited for the present invention because of its thermal qualities. Due to the characteristics of expandable polystyrene which consists of loosely knitted material, the walls or panels forming the present invention provide an insulation as well as a sound barrier. The respective panels 12 and 14 are spaced apart in parallel relation by means of interlocking end walls or panels 16 and a plurality of interposed strut members, designated generally at 18. Strut members 18 will hereinafter be described in more detail since these improved wall ties constitute the principle elements that establish a new and improved modular concrete-block form.

Figure 3:
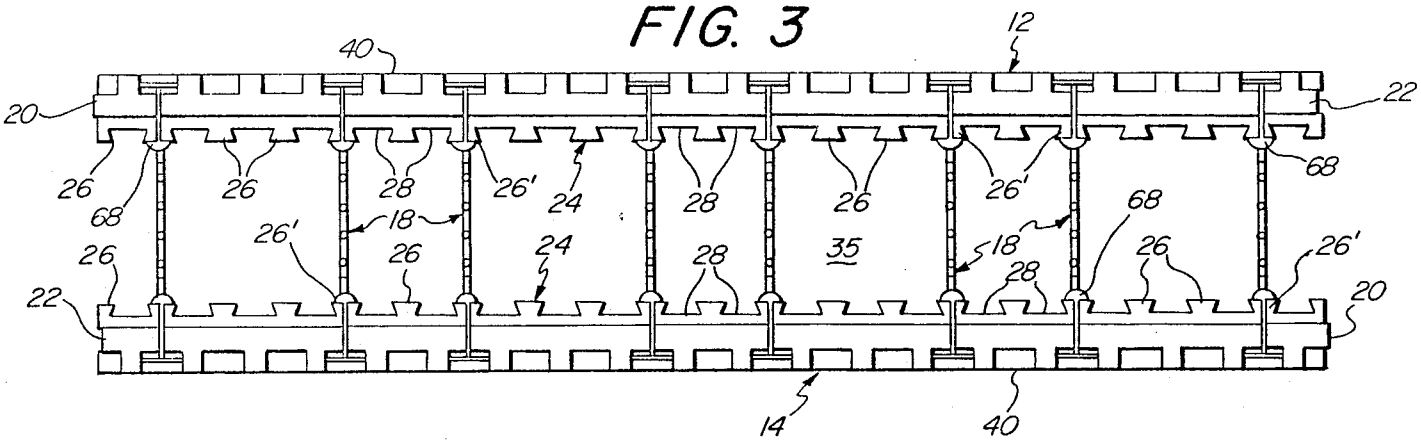
FIG. 3 is a top-plan view showing the elongated side panels secured together by a plurality of strut members.
Figure 4:
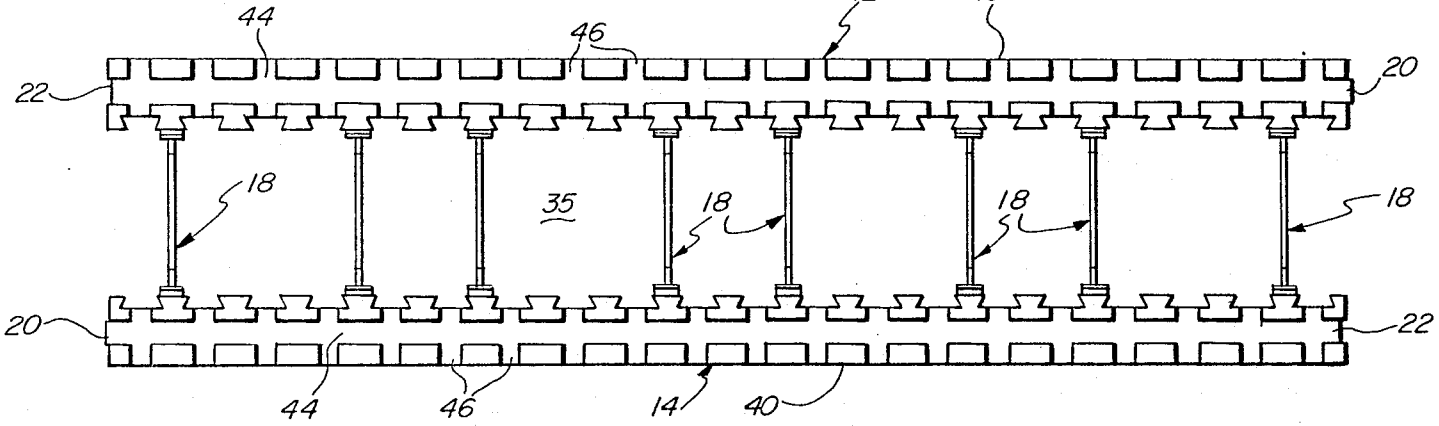
FIG. 4 is a bottom-plan view thereof.
Figure 5:
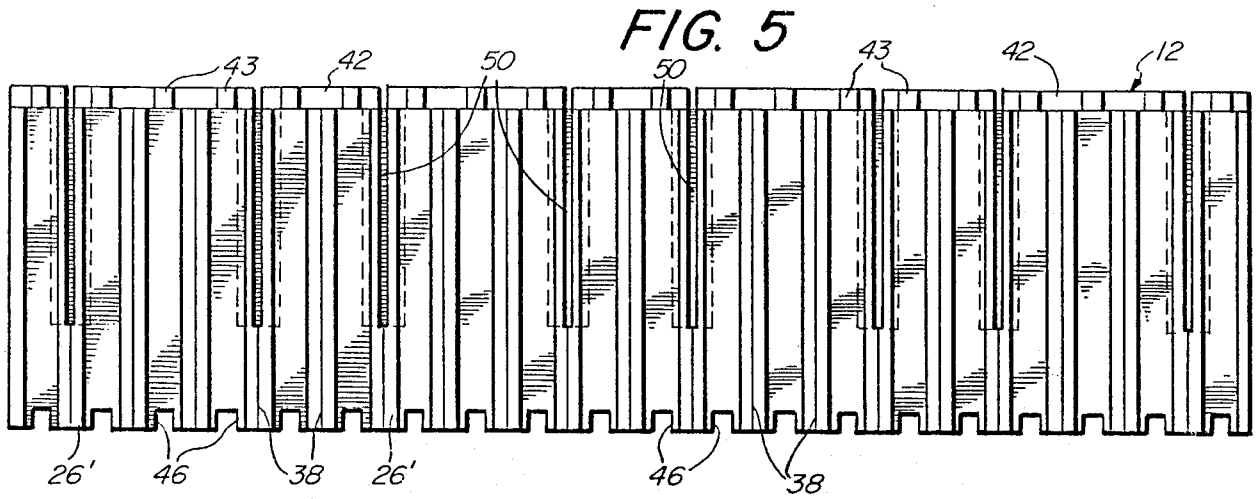
FIG. 5 is an elevational view of the inner face of a side panel.

The side walls or panels 12 and 14 are formed identically but are in reverse position from each other when arranged in parallel relation. That is, as shown in FIGS. 3 and 4, panel 12 is illustrated as having a male end defined by interlocking vertical ribs 20, and the opposite end thereof is provided with a vertical groove 22, as further shown in panel 14. Accordingly, only one panel need be formed to complete the respective oppositely disposed panels 12 and 14. Since the two panels are identical, their respective tongue-and-groove inner surfaces 24 are facing each other, with the ends of the panels being arranged in reverse to each other. This arrangement is inherent due to the use of a single panel structure for both sides, thus providing a simple and low-cost structure. Hence, only a detailed description of one side panel is required herein.

Each panel 12 and 14 is formed with a tongue-and-groove inner surface 24 which comprises a plurality of spaced-apart tongue members 26 defining contiguous interposed grooves 28. The preferred form of the tongues 26 and grooves 28 is that of a dovetailed configuration wherein each tongue is a projecting, wedge-shaped part that fits into the corresponding cut-out space (mortise) 28 to form an interlocking joint. However, other suitable configurations of the tongues and grooves are also contemplated. Accordingly, tongue members 26 and grooves 28 are vertically arranged in spaced relation to each other, and have a preferable spacing of two inches on center. This allows the elongated panel to be easily and readily cut to a particular length where required, and thus enable the modular concrete-block forms to be correctly sized for window and door openings when necessary.

Figure 8:
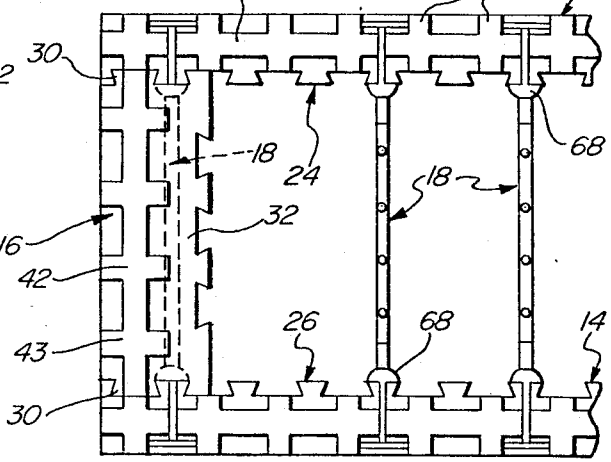
FIG. 8 is a top-plan view of one end of the block form having the end plate member interlocked between the side panels.
Figure 7:
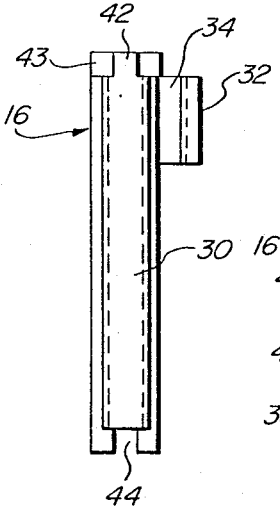
FIG. 7 is an end view of the end plate.
Figure 6:
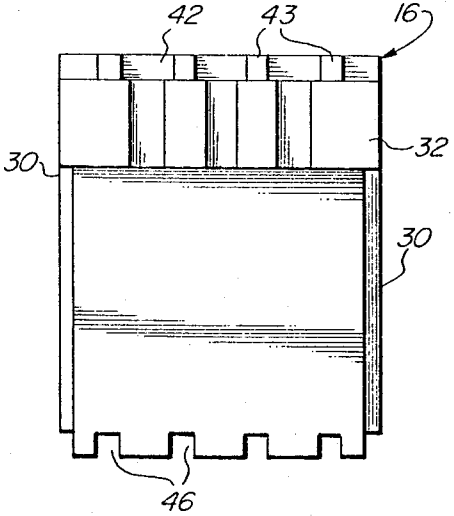
FIG. 6 is a side-elevational view of the inner face of an end plate member.

End panels 16 are employed as closure members and are formed with wedge-shaped projecting members 30 vertically along the outer edges thereof. These oppositely disposed projecting members are designed to be received in any groove member 28 along the inner surface of panels 12 and 14. (See FIG. 8.) To provide extra strength to end closure panels 16, each inner surface thereof includes an upper, transverse, enlarged body member 32 which is provided at each end with a wedge-shaped groove 34 to further establish a firm interlock between side panels 12 and 14. It is to be noted that body member 32 is only formed adjacent the upper end of end closure panel 16. This is done to allow a strut member 18 to be mounted in juxtaposition to end panels 16. Again, note FIG. 8 of the drawings.

Hence, it can be understood that, with side panels 12 and 14 and oppositely positioned end closure panels 16, a basic rectangular form is constructed to define a cavity 35 in which concrete is received to establish a permanent fixed structure.

Panels 12 and 14 are further provided with cutting lines 38 which are vertically located on both the inner surfaces 24 and outer surfaces 40, and are equally spaced starting at the ends of the panels. That is, cutting lines 38 start approximately two inches in from the ends of the side panels 12 and 14, the cutting lines being defined by recessed bands centrally positioned vertically along tongue members 26 on the inner wall surfaces 24. The recessed band formed in the outer wall surface 40 is located directly opposite thereto whereby the cutting of the side panels can be easily accomplished by known suitable means such as the use of a hot-wire cutting device.

Before describing in detail the strut member 18 and the means for securing the strut between side panels 12 and 14, it should be noted that the panels are provided with additional interlocking means that are formed along the upper and lower edges thereof. The upper edge is formed with a longitudinal rail member 42 which includes laterally protruding arm members 43. To establish a firm interlock between each block form when mounted one above the other, the bottom edge of each panel is formed with a longitudinal cavity 44, shown in FIG. 4. The cavity is also formed with lateral sockets 46. The formation of the upper edge rail and arm members 42 and 43, respectively, corresponds to that of cavity 44 and sockets 46. Arm members 43 and corresponding sockets 46 are centrally aligned with respect to wedged grooves 28. The upper and lower edges of end closure panels 16 are also formed with the same locking arrangement. This interlocking form is shown in its preferred configuration. However, other suitable interlocking means can be employed.

Figure 2:
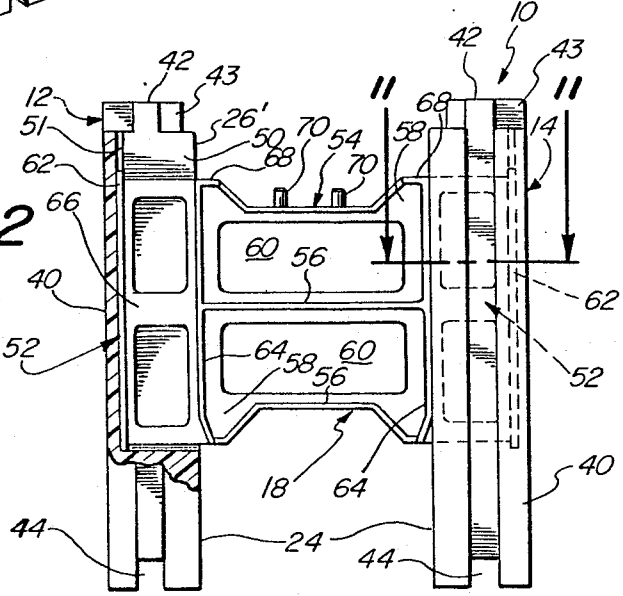
FIG. 2 is an enlarged end view of the present invention with a portion thereof broken away to show how the strut members are secured within the side panels.
Figure 11:
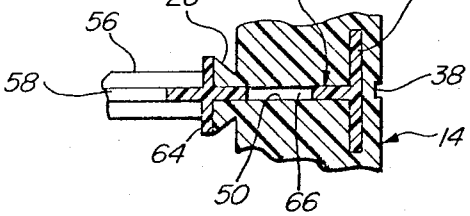
FIG. 11 is an enlarged cross-sectional view taken substantially along line 11—11 of FIG. 2.

Referring now to strut members 18 and to the manner in which struts 18 are transversely secured between side panels 12 and 14, the side panels 12 and 14 are provided with "T"-shaped slots 50 that extend vertically from the top of the panels to a point just below each midsection thereof. These slots are spaced apart in pairs, as seen in FIGS. 3 and 4, and are formed centrally in selective tongue members 26 which are noted at 26'. Each slot 50 is provided with a longitudinal slot defining a head portion 51 located adjacent the outer surface 40, as better seen in FIG. 2. Accordingly, "T"-shaped slot 50 defines a mortise adapted to receive tenon members, indicated generally at 52, on opposite ends of strut member 18. The tenon members are interconnected by means of a truss midsection 54 which comprises a plurality of transverse bar members 56. The bar members tie together each oppositely disposed tenon member 52 and thus define a very strong brace to support each side panel in a firm vertical and parallel position. To further provide strength to strut 18, an internal web 58 is integrally formed with the bar members 56 and tenon members 52, as seen in FIGS. 1 and 2. Web 58 defines openings 60 which permit full flow of wet concrete therebetween to allow cavity 35 to be completely filled with the filler material, that being the concrete. Each Tenon member 52 is formed in a generally "H"-shaped configuration which comprises an outer vertical stud member 62 and an inner vertical stud member 64 integrally connected by a transverse web frame member 66. Outer stud member 62 converges inwardly from top to bottom to define a wedge-shaped insert member that is forceably positioned into head portion 51 of "T"-shaped slot 50 so as to be firmly interlocked therein. Web frame 66 is positioned in slot 50 and the inner stud member 64 is forceably engaged with the inner surface 24 of each side panel 12 and 14, and more specifically stud member 64 engages tongue member 26'. To aid in forcing strut 18 in place at the midsection of each oppositely positioned panel, each inner stud member is provided with a thumb press shoulder 68. The bottom edge of the outer stud member should be resting on the bottom of slot 50, as seen in FIG. 2. When in this position, strut 18 is approximately located midway between the upper and bottom edges of panels 12 and 14.

It should be noted that the upper bar member 56 is formed with a plurality of pin members 70. The strut members as illustrated in FIGS. 1 and 2 are of a small configuration having two pin members that provide a means to position and secure at least two parallel concrete support bars (not shown). These bars are commonly used to a strengthen and support the concrete and wall sections created by the combination of the modular forms and concrete enclosed therein.

When constructing a modular concrete-block framework 10, each panel is cut to the required length. Struts 18 are then inserted in the "T" slots 50 as needed, with the end closure panels 16 being secured in place. Once formed in a typical rectangular configuration, the modular unit is ready to be positioned in a building structure and permanently fixed thereto by placing concrete within cavity 35 of block framework 10.

Figure 9:
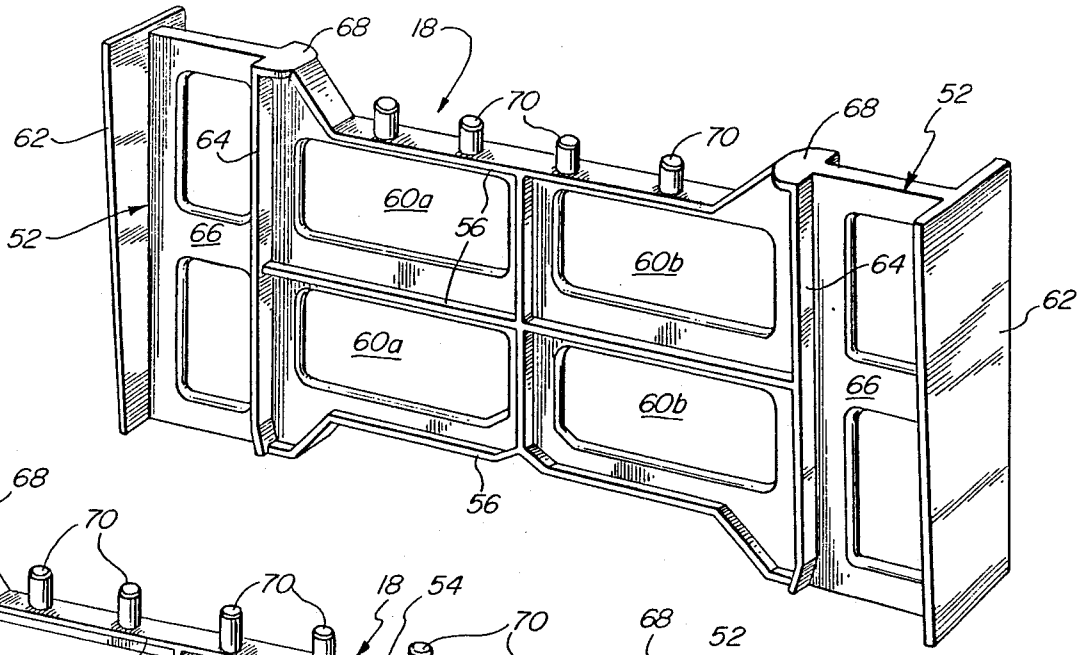
FIG. 9 is a perspective view of an alternative arrangement of a strut member.
Figure 10:
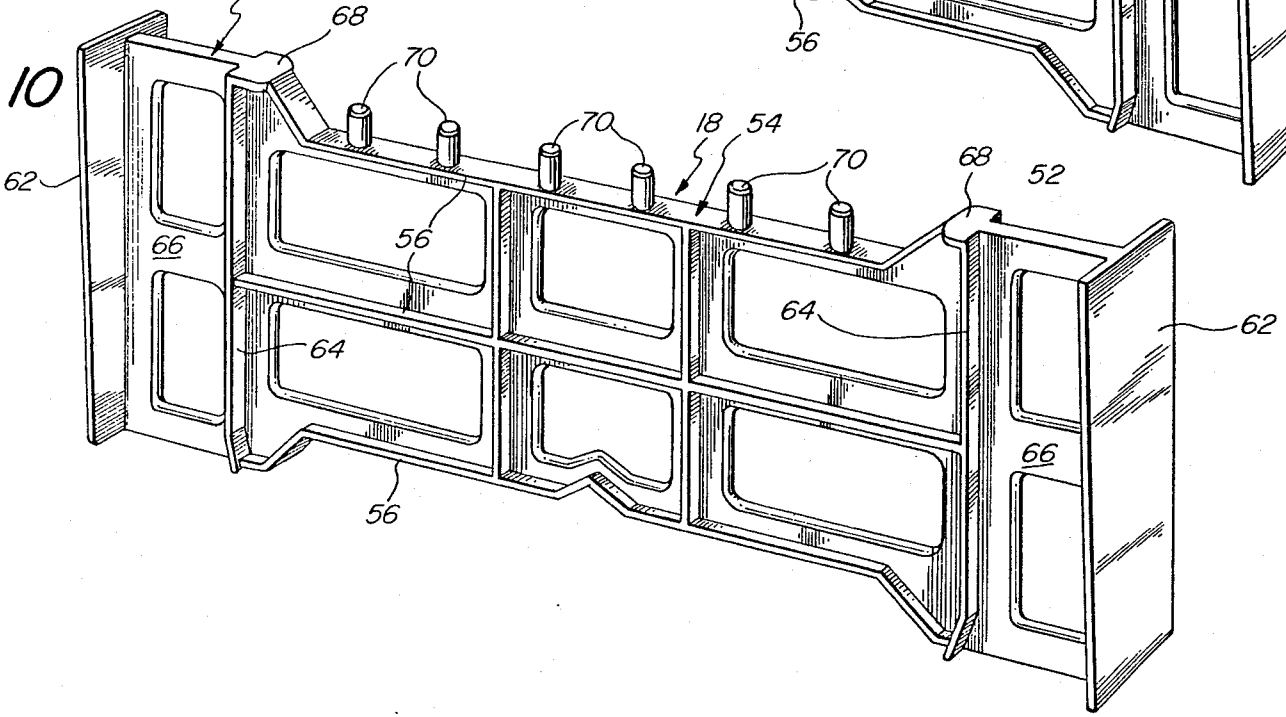
FIG. 10 is a perspective view of yet another alternative arrangement of the maximum sized strut member having three sets of flow holes formed therein for ease of flow of concrete being poured in an assembled block form.

FIGS. 9 and 10 illustrate various configurations of larger strut members 18, wherein member 18 of FIG. 9 includes two sets of openings **60*a*, and the strut member shown in FIG. 10 is of still a larger configuration having three sets of openings. As the lengths between the end tenon members 52 increase, the number of openings and the number of support pins 70 increase as well. The strut illustrated in FIG. 9 is also shown in the top-plan view of FIG. 8**.

The foregoing is a description of the preferred embodiments of the invention which are given here by way of example only. The invention is not to be taken as limited to any of the specific features as described, but comprehends all such variations thereof as come within the scope of the appended claims.

What is claimed is:

1. An improved, modular, concrete block form assembly wherein the assembly is formed in combination with strut members, said combination comprising:

a pair of oppositely disposed side panel members each having an inner and outer surface and vertically disposed interlocking end members;

interlocking means formed along the upper and lower longitudinal edges of said panels, said interlocking means being formed so that said upper and lower edges are interlocked with each other when said assemblies are stacked one on top of the other;

a plurality of equally spaced tongue-and-groove members vertically formed in said inner surface of said panels;

a plurality of T-shaped mortises spaced apart from each other and vertically located in said side panels, said T-shaped mortises being defined by transverse slots formed in vertical tongue members and longitudinally disposed head slots, said mortises extending to a midway point of each of said side panels;

a strut members having a web midsection and an H-shaped tenon member formed at each of the securing ends of said web midsection so as to be received in said respective mortises, said midsection of said strut member being formed having a plurality of truss members that define a plurality of flow-through openings formed therein to provide for an unobstructed flow of concrete therebetween;

said H-shaped tenon members being integrally formed with said truss members, and each tenon member including an outer stud member and an inner stud member integrally connected by a web frame member, wherein said outer stud member of each of said tenons is formed having a wedge-shaped configuration so as to be forcibly positioned in said head slot to provide a locking arrangement therewith, said inner stud being positioned against said inner surface of said side panels, thereby preventing movement relative thereto, and wherein said web frame member thereof is located within said transverse slot whereby longitudinal movement between said opposed panels is prevented.

2. The combination as recited in claim 1 including a pair of end closure panels interposed between said side panels and positioned adjacent the ends thereof, wherein said end closure panels are formed with a pair of tongue-and-groove members located on opposite outer ends of said closure panels for coupling said end closure panels to said side panels at the open ends of the block form when required.

3. The combination as recited in claim 1, wherein said stud member includes means for forcibly pressing said stud member in a firm fixed position between said side panels.

* * * * *